United States Patent [19]

Bertelsen

[11] 4,336,126

[45] Jun. 22, 1982

[54] PROCESS FOR BURNING RETORTED OIL SHALE AND IMPROVED COMBUSTOR

[75] Inventor: Corey A. Bertelsen, Oakland, Calif.

[73] Assignee: Chevron Research Company, San Francisco, Calif.

[21] Appl. No.: 246,555

[22] Filed: Mar. 23, 1981

[51] Int. Cl.[3] ..... C10G 1/00; C10G 1/02

[52] U.S. Cl. ..... 208/11 R; 208/8 R; 201/31; 201/32

[58] Field of Search ..... 208/11 R, 8 R; 201/31, 201/32; 202/99, 215

[56] References Cited

U.S. PATENT DOCUMENTS

| | | | |
|---|---|---|---|
| 3,167,494 | 1/1965 | Crawford | 208/8 R |
| 3,454,383 | 7/1969 | Pirsh et al. | 201/31 X |
| 3,655,518 | 4/1972 | Schmalfeld et al. | 202/108 |
| 3,756,922 | 9/1973 | Schmalfeld et al. | 201/31 X |
| 3,852,216 | 12/1974 | Ninomiya et al. | 201/31 X |
| 4,029,027 | 6/1977 | Smith | 110/28 |
| 4,165,717 | 8/1979 | Reh et al. | 122/4 |
| 4,199,432 | 4/1980 | Tamm et al. | 208/8 |
| 4,243,489 | 1/1981 | Green | 208/11 R X |
| 4,293,401 | 10/1981 | Sieg et al. | 208/11 R |

*Primary Examiner*—Delbert E. Gantz
*Assistant Examiner*—Glenn A. Caldarola
*Attorney, Agent, or Firm*—D. A. Newell; S. R. LaPaglia; J. W. Ambrosius

[57] ABSTRACT

Combustor and process for burning particularized oil shale by preburning separate fine and coarse particle feedstreams prior to mixing in the main combustion zone.

7 Claims, 2 Drawing Figures

PROCESS FOR BURNING RETORTED OIL SHALE AND IMPROVED COMBUSTOR

BACKGROUND OF THE INVENTION

Following the pyrolysis of oil shale to extract the volatile components, such as shale oil and hydrocarbon gases, a solid material remains which is referred to as "retorted oil shale". This material contains residual carbonaceous material which may be burned to yield heat energy. The heat recovered from the carbonaceous residue may be used to supply heat for the pyrolysis of the oil shale during the retorting process.

The inorganic residue that remains after the combustion of the carbonaceous material present in the retorted shale is called "burned shale". This material is recycled in some retorting processes as "heat transfer material", i.e., the hot burned shale from the combustion is mixed with raw oil shale and the heat provided is used for retorting the raw shale. In U.S. Pat. No. 4,199,432 a process is described in which the oil shale is retorted in a downward moving bed containing a mixture of recycled hot burned shale (used as a heat transfer material) and particulate raw oil shale. A countercurrent flow of gas passes upward through the bed removing the product vapors and pneumatically entraining the finer particulate fraction of the oil shale. The fine particles and product vapors are drawn off the top of the retorting vessel, and the fine shale particles are removed from the gas stream in a cyclone. Processes such as this present some problems in designing an efficient combustor for burning the retorted oil shale which is recycled as the heat transfer material.

During combustion of the carbonaceous residue in the retorted oil shale to produce heat, the physical integrity of the shale particles is changed and a substantial amount of fine grained burned shale is produced which is not suitable for use as recycled heat transfer particles. Therefore, it is necessary to separate this fine material prior to recycling the coarser grained particles.

In process schemes using a liftpipe combustor to burn the residual carbonaceous material in the retorted oil shale, sufficient residence time is required to complete combustion and to assure a thermal equilibrium between the hot burning particles and the cooler recycle particles. Typically, a minimum residence time of 2 to 3 seconds in the combustion zone is required. If the fine shale and coarse shale particles are combusted in a liftpipe, the pipe must be of sufficient length to provide adequate residence time for all particles.

The present invention is advantageous for efficiently burning particulate retorted oil shale where the fine grained material and the coarser grained material are separated prior to combustion and the burned shale serves as heat transfer material in the retorting process.

SUMMARY OF THE INVENTION

This invention concerns a combustion device for burning particulate retorted oil shale separated into a fine particulate feedstream and coarse particulate feedstream which comprises:

(a) a generally vertical main combustion chamber having an upper zone closed at the top, a middle zone, and a lower zone open at the bottom, said lower zone having means for pneumatically entraining solids entering said lower zone, said middle zone being an elongate tubular zone adapted for the combustion of entrained particulate solids, said upper zone being adapted for the disengagement of entrained coarse particles and for the collection and removal of the disengaged coarse particles, said upper zone further having an outlet for the removal of combustion gases and fine entrained particles;

(b) a generally vertical tubular fine solids combustion chamber adapted for burning pneumatically entrained fine solids, said fine solids combustion chamber having an open upper end communicating with the lower zone of the main combustion chamber, said fine solids combustion chamber further having a lower end having an inlet for the introduction of the fine particulate feedstream and means for pneumatically entraining the fine particulate material and conveying it the length of the fine solids combustion chamber;

(c) a coarse solids preburning chamber having an inlet for the introduction of the coarse particulate feedstream, means for fluidizing a burning bed of the coarse particulate material, and means for communication with the lower zone of the main combustion chamber.

The present invention is further directed to a process for producing heat from retorted oil shale containing residual carbonaceous material, wherein said retorted oil shale contains both fine and coarse grained material and at least part of said fine grained material is contained in a separate feedstream from the coarse grained material, said process comprising:

(a) burning at least part of the residual carbonaceous material in the fine grained material present in said separate feedstream in a fine preburner by entraining said fine particles in a first entraining gas stream containing oxygen and having a velocity greater than the terminal velocity of the fine particles;

(b) burning part of the carbonaceous residue in the coarse grained material in a coarse preburner containing less than a stoichiometric amount of oxygen;

(c) mixing the entrained partially burned fine grained material from the fine preburner and the partially burned coarse grained material from the coarse preburner in a second entraining gas stream having a velocity greater than the terminal velocity of the mixture of fine and coarse particles and containing at least a stoichiometric amount of oxygen; and (d) burning the carbonaceous residue remaining in the entrained fine and coarse grained material in a vertical combustion zone through which said second entraining gas is directed.

DETAILED DESCRIPTION OF THE INVENTION

Figure 1:
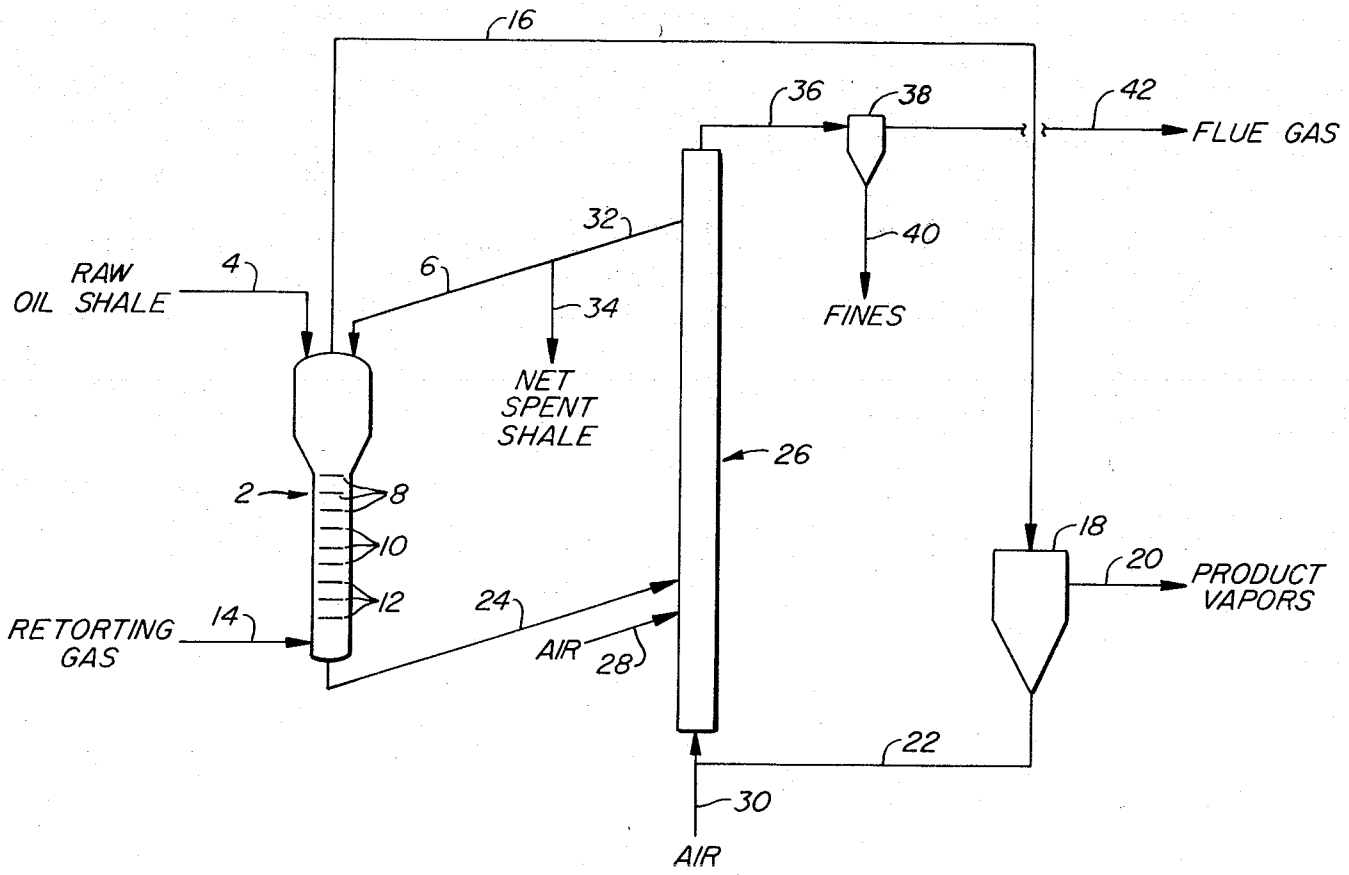
FIG. 1 is a schematic representation of an oil shale retorting process of the type in which the present invention may be used most advantageously.

Referring to FIG. 1, raw crushed oil shale enters retort 2 via conduit 4 where it is mixed with the hot heat transfer material (spent shale) entering the retort through conduit 6. The mixture of hot spent shale and raw shale moves downward in the retort 2 through a series of dispensing elements 8, 10 and 12 which prevent substantial vertical backmixing of the solids. A substantially oxygen free retorting gas enters retort 2 through gas inlet 14 creating a countercurrent gas flow through the retort in opposition to the downward moving bed of shale. Gas from the gas inlet 14, product vapors, and pneumatically entrained fine particles of shale move upward and leave the retort via conduit 16. The gas and product vapors are separated from the entrained fines in cyclone 18; the gaseous material exits by conduit 20 and the fines are carried away by conduit 22.

The coarse material containing particles of both burned oil shale and retorted oil shale leaves the bottom of retort 2 via solids conduit 24 and is conveyed to the combustor 26. Air entering the combustor via air conduit 28 is mixed with the coarse particles of shale and the residual carbonaceous material present in the retorted material is ignited. In this particular process scheme the fine particulate oil shale material separated by cyclone 18 enters the combustor as a separate feedstream from the coarse particulate material from the retort. The advantages of this scheme will be discussed in detail later. The fine material carried by conduit 22 is pneumatically entrained by air from conduit 30 and enters the combustor at the bottom. Following combustion of the carbonaceous residue the coarse particles of burned shale and fine particles of burned shale are separated in the top part of the combustor by a process explained in greater detail below. The coarse particles of burned shale leave the combustor via common conduit 32. Hot burned shale serving as heat transfer material is recycled to the retort via conduit 6 while excess burned shale is drawn off through outlet 34. Flue gases and entrained fines leave the combustor via conduit 36 and are carried to cyclone 38. Fines are disposed of through conduit 40. Flue gases are carried off via conduit 42 for venting or recycling as retorting gas.

Figure 2:
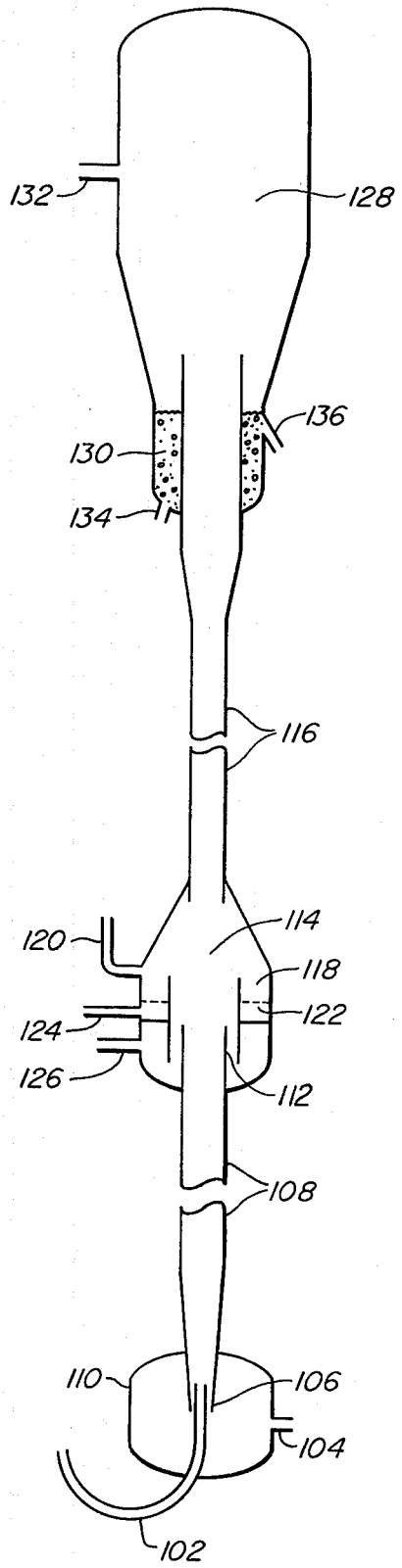
FIG. 2 illustrates a cross sectional view of a preferred embodiment of the combustion device of this invention.

Turning to FIG. 2, a combustion device suitable for use in the retorting process described above is illustrated in detail. Fine particles of shale from the retort are carried to the combustor by fine shale inlet line 102. Air entering air inlet 104 is distributed around the open end 106 of fine shale liftpipe 108 by air plenum 110. The pneumatically entrained fines are ignited and carried upward through fine shale liftpipe 108. The burning fines exit the open upper end 112 of the fine shale liftpipe 108 and enter the liftpipe engaging area 114 for the main combustion liftpipe 116.

Coarse shale from the retort enters the annular coarse shale preburning area 118 via inlet 120. A fluidized bed of coarse shale is supported by perforated plate 122 and burned with a fluidizing gas containing a substoichiometric amount of oxygen introduced via inlet 124. Coarse particles from the fluidized bed in the preburner 118 spill over into the liftpipe engaging area 114 of the main combustion liftpipe where they, along with fine shale from fine shale liftpipe 108, are entrained in a gas stream containing excess oxygen entering through primary air inlet 126. Both coarse and fine particles are carried upward by the gas stream and burned in the main combustion liftpipe 116. The burned particles of oil shale enter the enlarged upper zone 128 of the combustion device which serves as a coarse solids disengaging area. The coarse particles of burned shale settle out in collection zone 130 while the burned fines and flue gases leave the combustion device via outlet 132. Coarse particles of burned shale for recycling to the retort are drawn off via outlet 134. Excess burned coarse shale is removed via outlet 136 for disposal.

As used herein the phrase "fine particles of burned shale" refers to particles of a size unsuitable for recycling as heat transfer material. Usually particles smaller than about 100 to 200 mesh size (Tyler standard), i.e., about 75 to 100 microns in diameter, are not suitable for use in the retorting process. Therefore, particles below this range are preferably removed with the flue gas as entrained fines. The separation of the fine and coarse particles is inherent in the design of the upper disengaging area of the combustion device. By exclusion "coarse particles of burned shale" refer to particles larger than about 200 mesh size. It should be understood that the terms fine and coarse are relative terms, the size of which may vary somewhat depending on the exact details of the process scheme. Thus in process schemes where particles smaller than 200 mesh may be tolerated, the term fine may include particles of a smaller diameter. Likewise, under other circumstances particles of a larger minimum mesh size may be required and the definition of "fine" may be adjusted accordingly.

In carrying out the process that is part of this invention the fine particles of retorted oil shale are preferably burned in the fine shale liftpipe with a substoichiometric amount of oxygen, i.e., insufficient oxygen to allow complete combustion of the char. An air to fuel ratio in the range of from about 0.2 to about 0.9 would be suitable for operation. This is to prevent excessive carbonate decomposition. Usually temperatures in both the fine shale liftpipe and the coarse preburner are kept below about 1500° F.

To insure entrainment of the fine particles in the fine shale liftpipe a minimum gas velocity of about 4 to 6 feet per second is required to prevent choking, i.e., collapse of the solids in the pneumatic pipe. Preferably the velocity of the entraining gas is in the range of from about 10 feet per second to about 20 feet per second. In the preferred embodiment of this invention the fine particles have a residence time of about 1.5 to 2 seconds in the fine shale liftpipe which results in about 25% of the carbonaceous residue being burned in that zone (air/fuel mole ratio=0.25).

The coarse preburner is also operated in the substoichiometric mode and is usually designed to contain a bed of burning coarse material fluidized by a flow of gas from below.

The flow of gas through the main combustion liftpipe must be sufficient to entrain both the fine and the coarse particles of shale. Usually a gas velocity in the range of from about 50 feet per second to about 150 feet per second is employed, with a preferred range of from about 80 feet per second to about 100 feet per second. It should be noted the velocity of the gas in the main combustion liftpipe is usually higher than that in the fine shale liftpipe to insure entrainment of particles entering from the coarse preburner. Combustion in the main liftpipe is carried out with at least a stoichiometric amount of oxygen present, and usually an excess of oxygen is employed. In the preferred embodiment of this invention the velocity of the gas in the main combustion liftpipe is greater than that in the fine shale liftpipe.

As used in the specification and claims the phrase "terminal velocity" refers to the velocity of a gas stream necessary to entrain a given size of particles. Therefore, particles having a terminal velocity equal to or less than the velocity of a flow of gas will be pneumatically entrained.

The combustion device and process described herein has the advantage of minimizing the height of the liftpipe required to completely burn the particles of retorted oil shale. By preburning the coarse and fine shale in separate zones taking advantage of the relative sizes of both feeds, the total residence time required for combustion is satisfied in a shorter liftpipe.

Although the process of this invention is most advantageously used in an oil retorting process using recycled burned shale as the heat transfer material, the invention should not be limited to that retorting method. One skilled in the art can easily devise schemes by which other types of heat transfer material, such as for example ceramic compositions, sand, alumina, iron, steel or the like, are employed. In such an instance the heat transfer material may be simply mixed with the coarse shale feedstream to the combustor. Even in processes using spent shale as the principal heat transfer material, it is often necessary to add supplemental heat transfer material to the systems. Likewise, it is possible to devise other embodiments of the invention which could utilize the hot flue gas in retorting the raw oil shale or even use the combustor to heat water to produce steam.

What is claimed is:

1. In a process for retorting oil shale using a heat transfer material heated by burning retorted oil shale containing residual carbonaceous material, wherein said retorted oil shale contains both fine and coarse grained material and at least part of said fine grained material is contained in a separate feedstream from the coarse grained material, an improved process for burning the oil shale comprising:

(a) burning at least part of the residual carbonaceous material in the fine grained material present in said separate feedstream in a fine preburner by entraining said fine particles in first entraining gas stream containing oxygen and having a velocity greater than the terminal velocity of the fine particles;

(b) burning part of the carbonaceous residue in the coarse grained material in a coarse preburner containing less than a stoichiometric amount of oxygen;

(c) mixing the entrained partially burned fine grained material from the fine preburner and the partially burned coarse grained material from the coarse preburner in a second entraining gas stream having a velocity greater than the terminal velocity of the mixture of fine and coarse particles and containing at least a stoichiometric amount of oxygen; and (d) burning the carbonaceous residue remaining in the entrained fine and coarse grained material in a vertical combustion zone through which the entraining gas is directed.

2. Process of claim 1 wherein the fine grained material is partially burned in the fine preburner with a substoichiometric amount of oxygen.

3. Process of claim 1 wherein the temperature of the material burned in the coarse preburner and the fine preburner does not exceed 1500° F.

4. Process of claim 1 wherein the coarse grained material in the coarse preburner is contained in a fluidized bed.

5. Process of claim 1 wherein the velocity of the entraining gas in the fine preburner is less than the velocity of the gas stream in the vertical combustion zone.

6. Process of claim 5 wherein the velocity of the gas stream in the vertical combustion zone is in the range of from about 80 feet per second to about 150 feet per second and the velocity of the entraining gas in the fine preburner is in the range of from about 10 feet per second to about 20 feet per second.

7. Process of claim 1 wherein burned oil shale is used as heat transfer material.

* * * * *